US005571022A

United States Patent [19]

Schaarschmidt

[11] Patent Number: 5,571,022

[45] Date of Patent: Nov. 5, 1996

[54] ELECTRICAL CONNECTOR SUCTION PLATFORM FOR FACILITATING PICKING

[75] Inventor: Manfred Schaarschmidt, Bensheim, Germany

[73] Assignee: The Whitaker Corporation, Wilmington, Del.

[21] Appl. No.: 411,008

[22] Filed: Mar. 27, 1995

[30] Foreign Application Priority Data

Apr. 11, 1994 [GB] United Kingdom ..... 9407137

[51] Int. Cl.[6] ..... H01R 13/44

[52] U.S. Cl. ..... 439/135; 439/940

[58] Field of Search ..... 439/41, 42, 135, 439/136, 940

[56] References Cited

U.S. PATENT DOCUMENTS

| | | | |
|---|---|---|---|
| 3,187,227 | 6/1965 | Chu et al. | 439/41 X |
| 5,242,311 | 9/1993 | Seong | 439/135 |
| 5,249,977 | 10/1993 | Tanaka et al. | 439/135 |
| 5,260,514 | 11/1993 | Fruen, Jr. | 439/42 |

OTHER PUBLICATIONS

Samtec Surface Mount Interconnect Guide/Sep., 1991/(pp. 1–5).

*Primary Examiner*—Khiem Nguyen

[57] ABSTRACT

A connector assembly is provided with a suction platform having a suction surface on one side and pin receiving pipes extending on the other side for mounting onto contact pins of the connector assembly. The pipes are provided with pin receiving cavities that have a cross-sectional profile slightly twisted with respect to the square profile of the pin contacts such that insertion of the pin contacts thereinto causes resilient torsional biasing of the pipes, thereby causing sufficient frictional forces therebetween for picking of the connector assembly via the support platform. Advantageously the suction platform does not depend on the shape of the connector, but rather only on the size and pitch of the pins therefore enabling use for different connectors. Additionally, the suction platform is well adapted for compact connectors that are difficult to hold onto otherwise.

6 Claims, 4 Drawing Sheets

ELECTRICAL CONNECTOR SUCTION PLATFORM FOR FACILITATING PICKING

BACKGROUND OF THE INVENTION

1. Field of the Invention

This invention relates to a platform member positionable onto an electrical connector to provide a surface for picking the connector with a suction picking device.

2. Description of the Prior Art

A common automatic method of picking electrical connectors and placing them onto a printed circuit board, is by a vacuum-type pick and place machine that has a pipette which is placed against a smooth surface of the connector to be picked.

Some connectors, however, due to their compactness, do not provide a sufficiently large, smooth or accessible surface area for picking with the vacuum pipette. The latter is especially so, when considering that connectors for mounting to a printed circuit board must be picked on a surface facing in an opposing direction to the printed circuit board mounting face, this surface usually comprising either cavities extending into the connector for receptacle terminals, or contact pins projecting upwards therefrom. One way of overcoming this problem is shown in U.S. Pat. No. 5,249,977, whereby a separate cap member is provided, the cap member being latched to the connector and providing a suction surface on an upper face thereof.

Another way is shown in U.S. Pat. No. 5,242,311, where a cover is positioned by fitting onto pins of a header connector. For the latter, the cover is relatively rigid and the pin receiving cavity areas relatively unflexible. This may mean that under certain circumstances, retention to the pins may be unreliable or too strong. A more flexible, elastic holding means is desirable. Furthermore, there is high material usage, which is undesirable for such throw-away pieces.

For certain connectors it is difficult to provide a suitable and reliable latching means for cooperation with the cap member due to the compactness of the connector, and in certain cases some of the connectors are standardized and exterior geometry can not be modified. Furthermore, it would be desirable, whenever possible, to provide a suction platform for a connector, that does not need to be removed for connection of the connector to a mating connector.

SUMMARY OF THE INVENTION

It is therefore an object of this invention to provide a platform for an electrical connector that enables picking thereof by a vacuum machine, that is for compact connectors, and that is cost-effective and reliable.

It is a further object of this invention to provide a suction platform for picking electrical connectors that is unnecessary to remove from the connector prior to mating of the connector with a complementary connector.

It is a further object of this invention to provide a cheap and reliable suction platform for picking of electrical connectors, that does not rely on the outer shape of the connector, and that has low material usage.

Some objects of this invention have been achieved by providing a suction platform for assembly to an electrical connector having pin terminals, the platform having a base member and resilient pipes extending therefrom having cavities for receiving the pin terminals, the pipes resiliently biased when mounted to the pin terminals for gripping thereto.

Some objects of this invention have been achieved by providing a suction platform for receptacle connectors, comprising thin tape bonded on one side thereof to a mating face of the receptacle connector, the tape providing a smooth surface for suction picking on the other side thereof, the tape being sufficiently thin and breakable for allowing contact pins of a mating connector to pierce therethrough for connection to the receptacle connector.

Some objects of this invention have been achieved by providing a suction platform for receptacle connectors, the platform having a base and pin members extending therefrom for plugging into the receptacle contacts of the receptacle connector, the pin members having thickened portions for reliable, positive, retention to the receptacle contacts.

DETAILED DESCRIPTION OF THE PREFERRED EMBODIMENT

Figure 1:
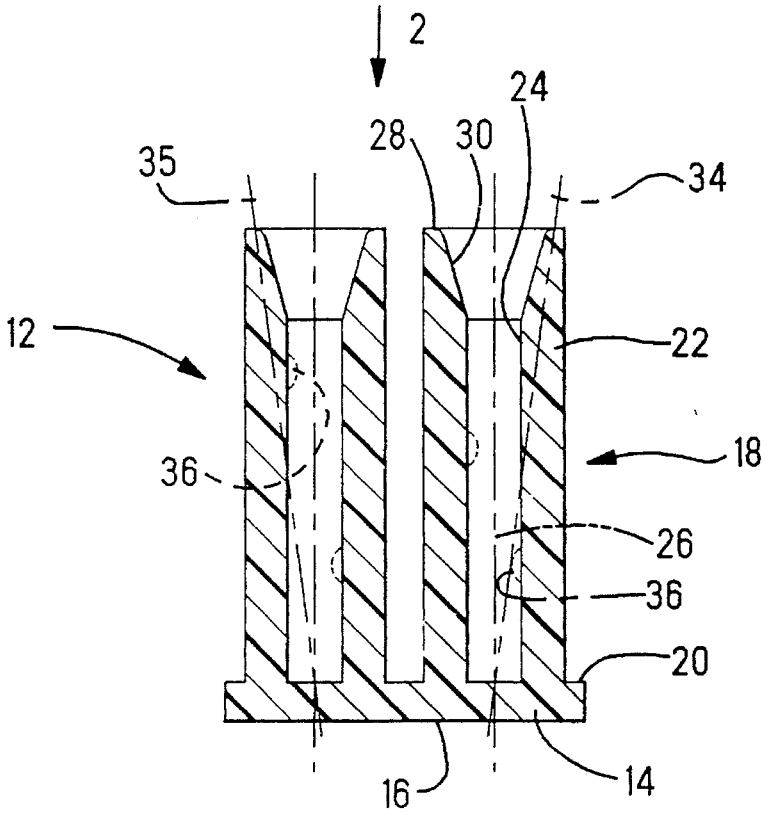
FIG. 1 is a cross-sectional view through lines 1—1 of FIG. 2 showing a pin-header suction platform.
Figure 2:
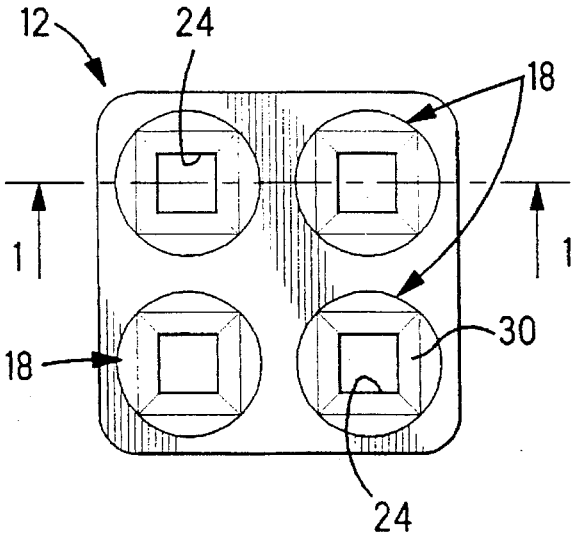
FIG. 2 is a view in the direction of arrow 2 of FIG. 1.
Figure 5:
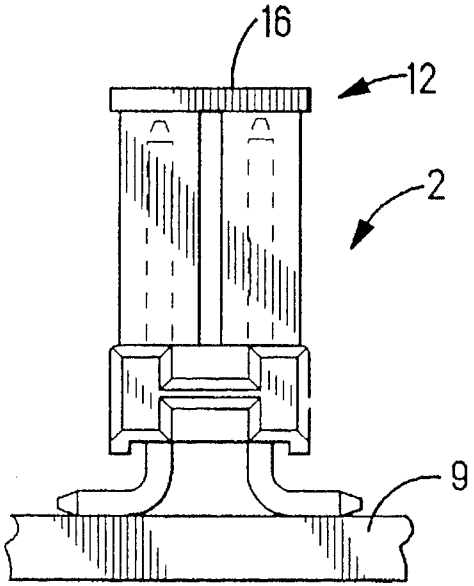
FIG. 5 is a view in the direction of arrow 5 of FIG. 3.
Figure 3:
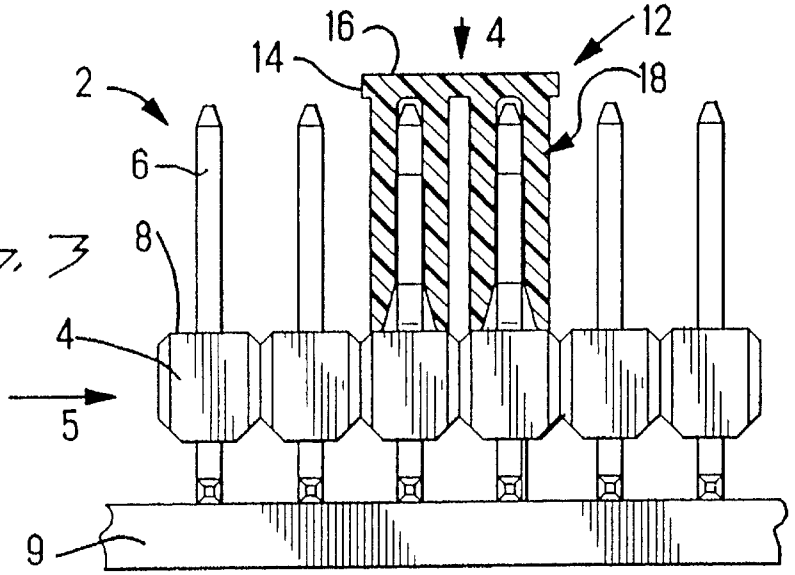
FIG. 3 is a partial cross-sectional view showing the suction platform mounted on a pin header connector.
Figure 4:
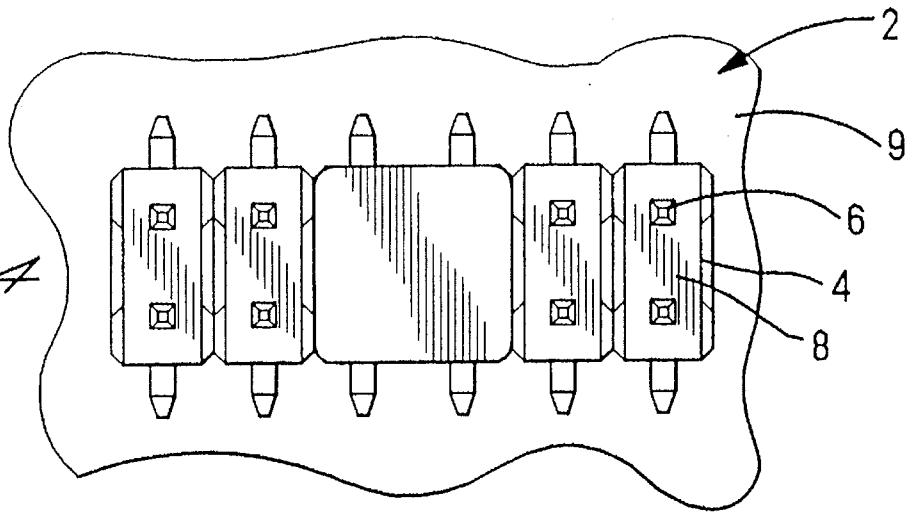
FIG. 4 is a view in the direction of arrow 4 of FIG. 3.

Referring first to FIGS. 3–5, a pin header connector assembly 2 comprises a connector housing 4 having pin terminals 6 mounted therein and projecting beyond a mating face 8 thereof, the terminals 6 for connection to conducting pads (not shown) of a printed circuit board 9. The pin terminals 6 have a non-circular cross-sectional profile, and in this example the cross-section is square. The connector assembly 2 further comprises a suction platform 12 having a base plate 14 with a suction surface 16 on the one side and resilient pipes 18 extending from the other side perpendicularly to the base section. Referring now to FIGS. 1 and 2, the pipes 18 comprise a pipe housing 22 having a pin receiving cavity 24 having a cross-sectional profile that is slightly twisted about a longitudinal axis 26 of the cavity 24 with respect to the cross-sectional profile of the pin for reception into the cavity 24. Extending into the cavity 24 from a pin receiving end 28, is a tapered lead-in portion 30 for guiding the contact pin therein. There are a plurality of pipes 18 spaced apart to receive corresponding pins of the pin header, whereby the spacing could be for pins directly adjacent to each other but could also be for receiving contact pins that are not directly adjacent each other.

During assembly of the suction platform 12 to the non-circular pins of the connector assembly 2, the pin receiving pipes 18 are resiliently twisted such that the cavity cross-sections are angled to match the contact pin cross-sections thereby allowing insertion of the contact pins fully into the cavities 24. The torsional bias of the pipes 18 against the contact pins thus provides high frictional force therebetween such that the suction platform 12 is held with sufficient frictional force to the connector assembly 2 in order to allow picking thereof via the suction platform 12.

The pin header suction platform 12 as described above, is therefore not dependent on the outer geometry of the connector assembly, but only on the geometry and spacing of the contact pins. This has the advantage of enabling a family of different pin header connectors to be assembled to the suction platform 12, as long as the cross-sectional profile of the pins, and the spacing therebetween is the same. One could of course also have different pin spacings as long as the spacings were integer factors thereof, whereby one could provide a suction platform for the largest spacing which would therefore be adaptable to the smaller pitches.

It would also be conceivable to provide pin receiving pipes 18 that grip onto the pin terminals of the connector assembly by resilient deformation other than torsion, for example the pipes could be angled with respect to each other slightly from the perpendicular as shown by the lines 34, 35 such that when the suction platform 12 is mated to the pins, the pipes 18 are resiliently biased towards each other such that they are parallel. In the latter case, the angle of inclination 34 and the size of the tapered lead-in 30 would have to be adapted to allow entry of the pins into the cavities 24. One could also imagine providing a cavity 24 that is non-linear e.g. slightly arcuate and which is resiliently straightened during entry of the pin contacts thereinto. Other possibilities would be to provide protrusions within the cavities 24 in interference with the contact pins. The latter solutions could of course also be used for connector assemblies having contact pins with circular cross-sections.

Figure 8:
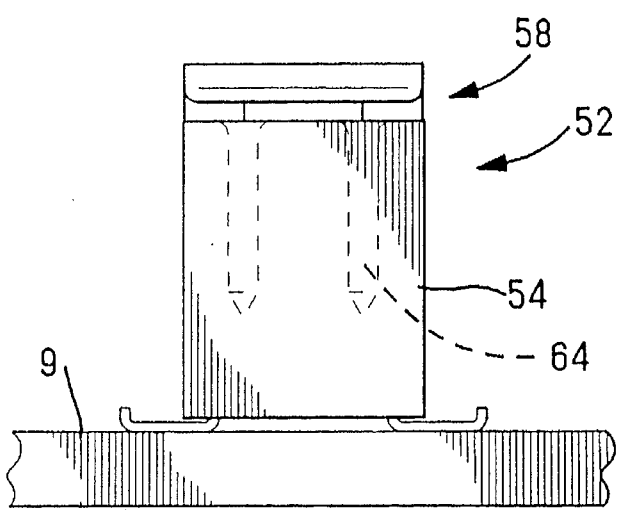
FIG. 8 is a view in the direction of arrow 8 of FIG. 6.
Figure 6:
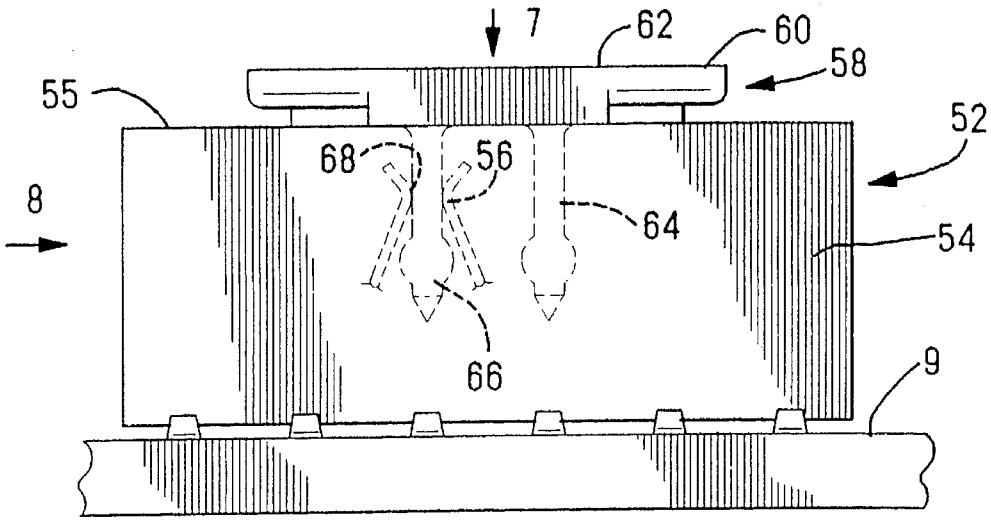
FIG. 6 is a side view of a receptacle connector with a suction platform.
Figure 7:
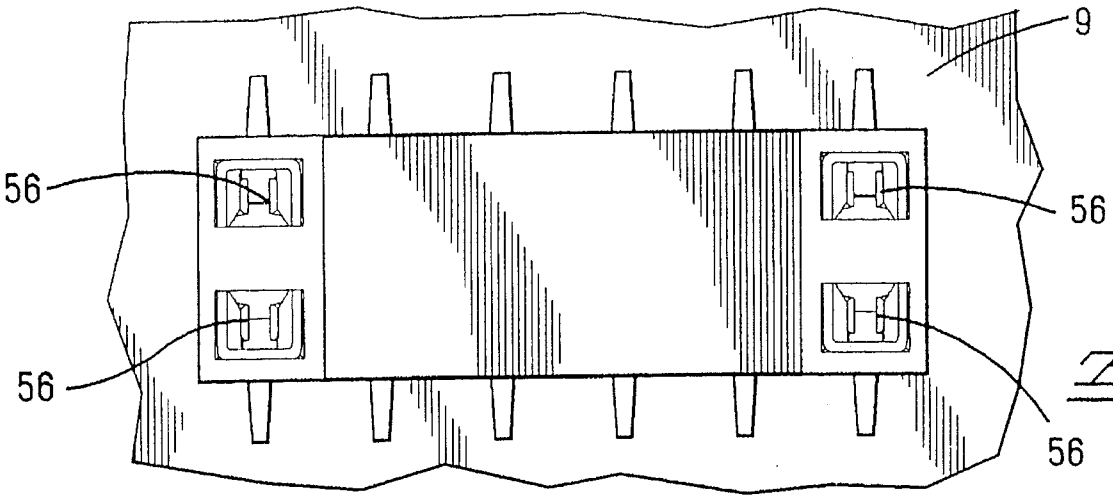
FIG. 7 is a view in the direction of arrow 7 of FIG. 6.

Referring now to FIGS. 6–8, a receptacle connector assembly 52 is shown comprising a housing 54, receptacle terminals 56 therein and a suction platform 58 having a base plate 60 with a suction surface 62 on one side thereof and pins 64 extending from another side thereof, the pins 64 receivable in the receptacle contacts 56. The suction platform 58 is thus held to the connector assembly by the resilient receptacle contacts 56 which frictionally engage the pin sections 64. The pins 64 can also be provided with a thickened lower end 66 to ensure that the suction platform 58 does not fall off the connector inadvertently when being handled. When the suction platform 58 is assembled to the connector, the thickened ends 66 are inserted past the contact points 68 of the receptacle contacts 56 against the pins 64. The suction platform 58 can of course have as many pins 64 as required to have sufficient force to lift up the connector assembly 52 reliably, and as with the pin-header suction platform 12, the pins 64 can be positioned at a large pitch for use with connector assemblies having the same or smaller centre-line pitches. The connector assembly 52 is shown with two rows of contacts, but of course the invention is applicable to any disposition of the contacts.

Advantageously therefore, the provision of the suction platform 12 having resilient pipes 18 that fit over and frictionally grip pin terminals of a pin-header connector assembly 12, provides a simple, cost-effective and reliable solution. The latter does not depend on the exterior geometry of the connector, nor require any particular clasping surfaces thereon whilst being usable for a range of different connectors that have the same pin terminals arranged in the same pitch or an integral factor thereof. The same advantages apply for the suction platform for receptacle connectors that have pins extending therefrom.

It should be noted, that resilient deformation of the pin terminals also occurs, and depending on the resiliency of the terminals, will contribute to varying degrees in frictional gripping of the terminals to the suction platform.

Figure 10:
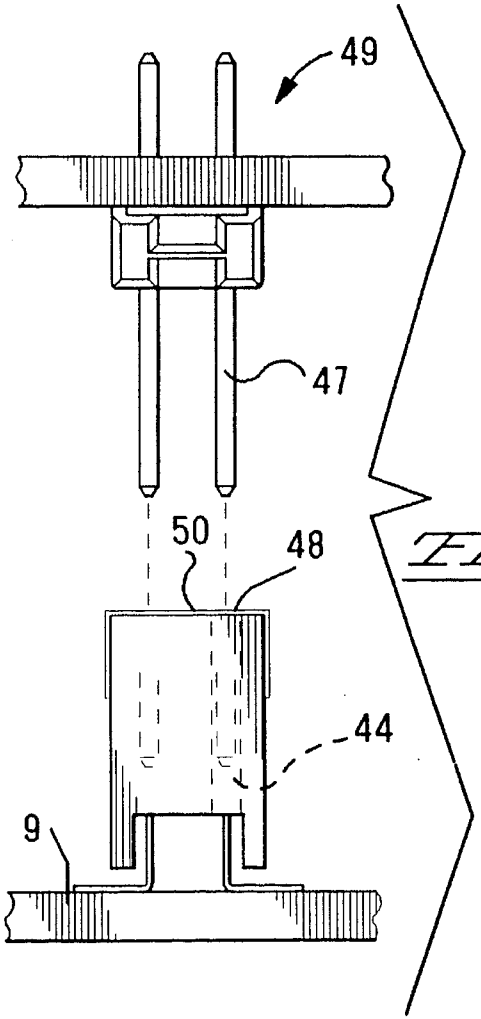
FIG. 10 is a view in the direction of arrow 10 of FIG. 9.
Figure 9:
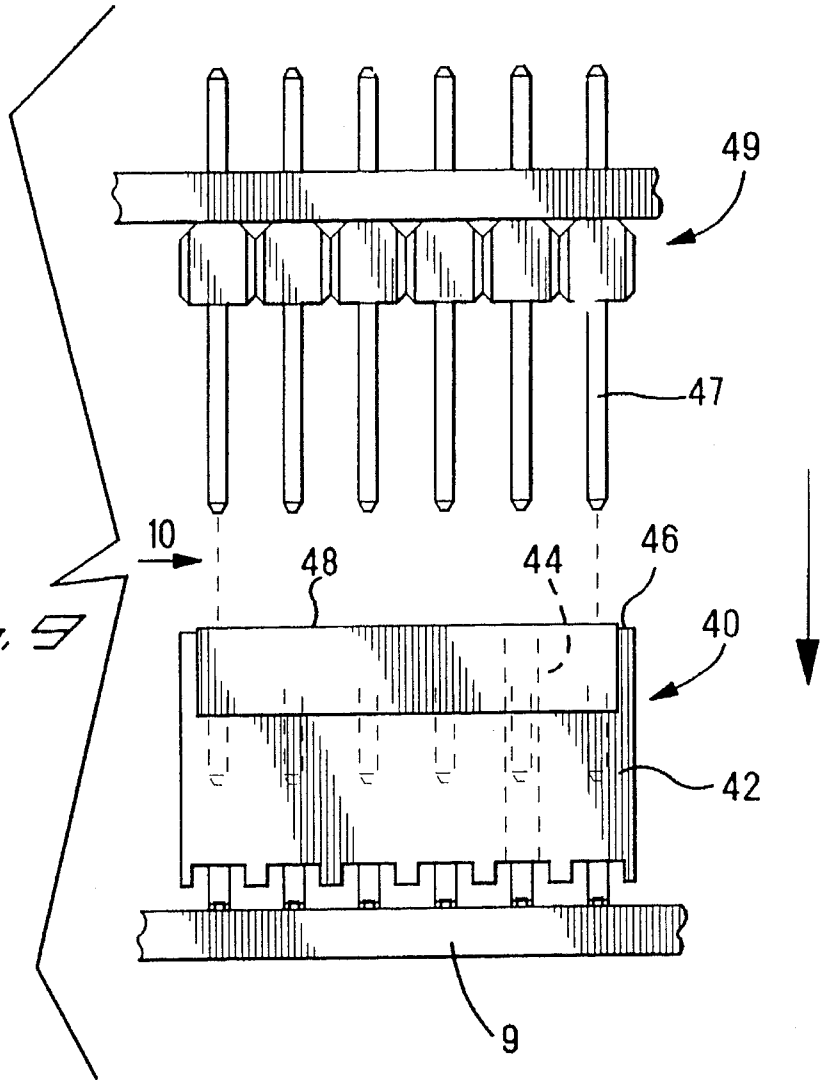
FIG. 9 is a side view of a receptacle connector matable with a pin-header connector, the receptacle connector having tape thereon.

Referring now to FIGS. 9–10, a receptacle connector assembly 40 is shown comprising a housing 42 with terminal receiving cavities 44 extending from a mating face 46 thereinto, and a suction platform 48 comprising a piece of thin tape bonded to the mating face 46 with an adhesive (e.g. the tape is provided with adhesive on one side) whereby the tape covers a plurality of cavities 44 thereby providing a smooth upper surface 50 of sufficient surface area for vacuum picking the connector assembly 40. The tape 48 is sufficiently thin and breakable to allow pin terminals 47 of a mating connector assembly 49 to pierce therethrough for electrical connection to the receptacle connector assembly 40.

Advantageously therefore, the provision of the tape 48 as a suction platform for receptacle connectors, provides a very cost-effective solution not only to manufacture but also to handle and for interconnection to a complementary connector.

I claim:

1. A connector assembly comprising a housing having a mating face from which pin contacts extend, and a separate suction platform assembled to the connector assembly over a portion of the mating face, the suction platform held to the connector assembly sufficiently strongly for picking up the assembly thereby, the suction platform comprising a base plate having a suction surface on one side and an extension projecting from the other side thereof, the extension frictionally engageable with the contacts for frictionally retaining the suction platform to the connector assembly during picking, the connector assembly being characterized in that the extension is a plurality of pin receiving pipes coextending from the base plate, each pipe comprising an outer wall, surrounding a pin receiving cavity, each cavity being profiled to receive a respective pin contact therein with space between individual pipes defining clearance permitting deflection of a respective wall irrespective of the adjacent pipes, such that relative resilient deformation of the pipe outer wall with respect to the pin contact occurs, thereby resulting in frictional force therebetween for retention of the suction platform to the connector assembly.

2. The connector assembly of claim 1 characterized in that the pin receiving pipes are profiled for receiving non-cylindrical pin contacts, the profile of the pipes being twisted about the axial axis of the pin contacts such that the pipes are resiliently torsionally deformed when the pin contacts are inserted thereinto.

3. The connector assembly of claim 1 characterized in that the pin receiving cavities of the pipes have protrusions therein for resiliently biasing against the pin contacts for frictional engagement thereagainst.

4. The connector assembly of claim 1 characterized in that the pin receiving pipes have axes non-parallel to the pin contacts in the unassembled condition such that resilient bending deformation of the pipes occurs when the pin contacts are inserted thereinto for frictionally gripping thereto.

5. The connector assembly "of" as in any of the preceding claims, in which "characterized in that" the outer wall of the pin receiving pipes "(18)" completely encloses the cavity therein except for a pin entry end.

6. A connector assembly comprising a housing having a mating face from which receptacle contacts extend, and a separate suction platform assembled to the connector assembly over a portion of the mating face, the suction platform held to the connector assembly sufficiently strongly for picking of the assembly thereby, the suction platform comprising a base plate having a suction surface on one side and extensions projecting from the other side thereof, each extension frictionally engageable with the contacts for frictionally retaining the suction platform to the connector assembly during picking, characterized in that the extensions are pins receivable in the receptacle contacts and having thickened portions insertable past contact points of the receptacle contacts to ensure reliable retention of the pins to the receptacle contacts.

* * * * *